United States Patent [19]

Abe et al.

[11] Patent Number: 4,695,529

[45] Date of Patent: Sep. 22, 1987

[54] IMAGE-FORMING PROCESS

[75] Inventors: Akira Abe; Junya Nakajima; Toshihiro Nishikawa, all of Kanagawa, Japan

[73] Assignee: Fuji Photo Film Co., Ltd., Kanagawa, Japan

[21] Appl. No.: 919,110

[22] Filed: Oct. 15, 1986

[30] Foreign Application Priority Data

Oct. 17, 1985 [JP] Japan ..... 60-232725

[51] Int. Cl.[4] ..... G03C 5/38; G03C 7/42

[52] U.S. Cl. ..... 430/351; 430/430; 430/455; 430/445; 430/427; 430/393; 430/418; 430/460; 430/567

[58] Field of Search ..... 430/419, 430, 455, 445, 430/463, 427, 393, 418, 460, 567, 351

[56] References Cited

FOREIGN PATENT DOCUMENTS 0136744 7/1985 Japan ..... 430/418

OTHER PUBLICATIONS

Research Disclosure, 20821, A Method of Photographic Processing . . . , Aug. 1981, pp. 311–314.

Research Disclosure 20744, Bleaching and Bleach–Fixing in Photographic Processing, Jul., 1981, p. 271.

*Primary Examiner*—Richard L. Schilling

*Assistant Examiner*—Patrick Doody

*Attorney, Agent, or Firm*—Sughrue, Mion, Zinn, Macpeak, and Seas

[57] ABSTRACT

An image-forming process is disclosed, which comprises exposing a silver halide color photographic material comprising a support having provided thereon at least one silver halide emulsion layer containing tabular silver halide grains having a diameter-to-thickness ratio of 5 or more, subjecting the exposed photographic material to color development processing, then processing the photographic material in a bath mainly having a bleaching ability and successively in a bath having a bleach-fixing ability.

9 Claims, No Drawings

IMAGE-FORMING PROCESS

FIELD OF THE INVENTION

This invention relates to an image-forming process using a silver halide color photographic material (hereinafter referred to as color light-sensitive material). More particularly, it relates to a method of processing particularly effective for forming a high-quality images in a silver halide photographic material containing tabular silver halide grains (hereinafter referred to as tabular grains) as the silver halide grains.

BACKGROUND OF THE INVENTION

Fundamental step of processing color light-sensitive materials generally include a color-developing step and a silver-removing step. In the color-developing step, exposed silver halide is reduced with a color-developing agent to produce silver and, at the same time, the oxidized color-developing agent in turn reacts with a color former (coupler) to give a dye image. In the subsequent silver-removing step, silver having been produced in the color-developing step is oxidized with an oxidant, then converted to a soluble silver complex by the action of a fixing agent, thus being dissolved away.

In addition to the above-described fundamental steps, actual development processing involves various auxiliary steps such as treating the color light-sensitive material in a hardening bath, a stopping bath, an image-stabilizing bath, a water-washing bath, etc. for the purpose of maintaining the photographic and physical qualities of the image, or for improving the preservability of the image.

In recent years, accelerated processing, or shortening of processing time, has been strongly desired. Particularly, shortening of a silver-removing step, which occupies almost a half of the total processing time, has been a subject of great interest to those devoted towards decreasing development time.

Heretofore, as a means for accelerating the silver-removing step, a bleach-fixing solution containing a ferric aminopolycarboxylate complex salt and a thiosulfate as described in German Pat. No. 866,605 has been known. However, when allowed to coexist with the thiosulfate having reducing power, the ferric aminopolycarboxylate originally having a weak oxidizing power (bleaching power) undergoes such a serious reduction of bleaching power that it is extremely difficult to fully remove silver from a high-speed, high-silver content color photographic light-sensitive material. Thus, this means for accelerating the silver-removing step is scarcely used in practice. On the other hand, another technique for increasing the bleaching power comprises adding various bleaching accelerators to a bleaching bath, a bleach-fixing bath, or a pre-bath thereof. Examples of these bleaching accelerators include various mercapto compounds, as described in U.S. Pat. No. 3,893,858, British Pat. No. 138,842, Japanese Patent Application (OPI) No. 141,623/78 (the term "OPI" as used herein means an "unexamined published application"), disulfido bond-containing compounds, as described in Japanese Patent Application (OPI) No. 95,630/78, thiazolidone derivatives, as described in Japanese Patent Publication No. 9,854/78, isothiourea derivatives, as described in Japanese Patent Application (OPI) No. 94,927/78, thiourea derivatives, as described in Japanese Patent Publication Nos. 8,506/70 and 26,586/74, thioamide compounds, as described in Japanese Patent Application (OPI) No. 42,349/74, and dithiocarbamic acid salts as described in Japanese Patent Application (OPI) No. 26,506/80, etc.

However, even the addition of these bleaching accelerators to a bleaching bath, a bleach-fixing bath or a pre-bath thereof still fails to fully accelerate the processing to a desirable speed. Thus, further improvements in acceleration have been desired.

On the other hand, as a technique for enhancing sensitivity of silver halide color photographic materials, a technique of using tabular grains has been developed. This technique is useful for enhancing sensitivity without spoiling image quality. However, this method has the defect that silver cannot be fully removed therefrom by a conventional silver-removing process, and further, that this technique causes an increased occurrence of magenta stains.

SUMMARY OF THE INVENTION

It is, therefore, an object of the present invention to provide a process for forming a high-quality image without magenta stains by accelerating removal of silver from a color light-sensitive material containing tabular grains to thereby shorten the processing time.

Another object of the present invention is to provide an image-forming process intended to maximize the inherent photographic properties of a color light-sensitive material containing tabular grains.

As a result of intensive investigations to stain the above-described objects, the inventors have found that, when a color-developed color light-sensitive material containing tabular grains is bleached and successively processed in a bath having a bleach-fixing ability, the light-sensitive material which has previously been difficult to remove silver therefrom can be rapidly processed and, as a result, an excellent image having no magenta stains can be obtained in accordance with the present invention.

That is, the present invention relates to an image-forming process which comprises imagewise exposing a silver halide color photographic material comprising a support having provided thereon at least one silver halide emulsion layer containing tabular silver halide grains having a diameter-to-thickness ratio of 5 or more, subjecting the exposed photographic material to color development processing, then successively processing the photographic material in a bath mainly having a bleaching ability and in a bath having a bleach-fixing ability.

DETAILED DESCRIPTION OF THE INVENTION

In the present invention, the bath mainly having a bleaching ability (hereinafter referred to as "a bleaching bath") means a bath which is intended to bleach silver deposits by incorporating therein a bleaching ingredient.

Specifically this bleaching bath is capable of bleaching at least $\frac{1}{2}$, preferably $\frac{2}{3}$ or more, more preferably 4/5, of the maximum amount of silver deposits contained in a color light-sensitive material. The bath may have a silver-removing ability in addition to the bleaching ability, provided that the silver-removing ability is not strong enough to remove $\frac{1}{2}$ or more, preferably $\frac{1}{3}$ or more, more preferably 1/5 or more of the total amount of silver in the color light-sensitive material.

The bath having a bleach-fixing ability (hereinafter merely referred to as "a bleach-fixing bath") means a bath which can bleach only less than $\frac{1}{2}$, preferably less than $\frac{1}{3}$, more preferably less than 1/5, of the maximum amount of the silver deposits contained in a color light-sensitive material. In addition, this bleach-fixing bath can bleach at least $\frac{1}{2}$, preferably $\frac{2}{3}$ or more, more preferably 4/5 or more of the amount of total silver contained in a color light-sensitive material.

It suffices to provide a total of 4 or less of the above-described bleaching bath and bleach-fixing bath, with each bath optionally comprising two or more baths. A water-washing step (including a washing bath using a reduced amount of water) may be provided between the steps employing the bleaching bath and the bleach-fixing bath. Further, an overflow solution from the bleaching bath produced as a result of introducing thereinto a replenisher can be directly or indirectly (preferably directly) introduced into a successive bleach-fixing solution, whereby a replenishing bleaching agent to be added to the bleach-fixing solution may be eliminated partly or wholly.

Bleaching agents contemplated for use in the bleaching bath and the bleach-fixing bath to be used in the present invention may be selected from among known agents such as red prussiate, dichromates, persulfates, inorganic ferric salts, organic ferric salts, etc. However, it is particularly preferred to use ferric aminopolycarboxylate complex salts since they cause less pollution of water, cause less metal corrosion and possess good stability. The ferric aminopolycarboxylate complex salts are complexes between ferric ion and aminopolycarboxylic acids or salts thereof.

Typical examples of the aminopolycarboxylic acids and salts thereof are illustrated below which, of course, do not limit the present invention in any way:

A-1 Ethylenediaminetetraacetic acid
A-2 Disodium ethylenediaminetetraacetate
A-3 Diammonium ethylenediaminetetraacetate
A-4 Tris(trimethylammonium) ethylenediaminetetraacetate
A-5 Tetrapotassium ethylenediaminetetraacetate
A-6 Tetrasodium ethylenediaminetetraacetate
A-7 Trisodium ethylenediaminetetraacetate
A-8 Diethylenetriaminepentaacetic acid
A-9 Pentasodium diethylenetriaminepentaacetate
A-10 Ethylenediamine-N-(β-hydroxyethyl)-N,N',N'-triacetic acid
A-11 Trisodium ethylenediamine-N-(β-hydroxyethyl)-N,N',N'-triacetate
A-12 Triammonium ethylenediamine-N-(β-hydroxethyl)-N,N',N'-triacetate
A-13 Propylenediaminetetraacetic acid
A-14 Disodium propylenediaminetetraacetate
A-15 Nitrilotriacetic acid
A-16 Trisodium nitrilotriacetate
A-17 Cyclohexanediaminetetraacetic acid
A-18 Disodium cyclohexanediaminetetraacetate
A-19 Iminodiacetic acid
A-20 Dihydroxyethylglycine
A-21 Ethyl ether diaminetetraacetic acid
A-22 Glycol ether diaminetetraacetic acid
A-23 Ethylenediaminetetrapropionic acid Of these compounds, A-1 to A-3, A-8, and A-17 are particularly preferred as bleaching agents in the present invention.

The ferric aminopolycarboxylate complex salts may be used in the form of a complex salt, or ferric ion complex salts may be formed in situ in solution by using a ferric salt such as ferric sulfate, ferric chloride, ferric nitrate, ferric ammonium sulfate, ferric phosphate or the like and an aminopolycarboxylic acid. Where using the complex salt form, one, two or more complex salts may be used. On the other hand, for forming complex salts in solution using ferric salts and aminocarboxylic acids, one, two or more ferric salts may be used. In addition, one, two or more aminocarboxylic acids may be used. In both cases, aminopolycarboxylic acids may be used in excessive amounts, i.e., more than enough to form the ferric ion complex salts.

The bleaching solution or the bleach-fixing solution containing the above-described ferric ion complex salt may further contain complex salts of metal ions other than iron (ferric) ion such as cobalt ions or copper ions.

The bleaching bath or the bleach-fixing bath of the present invention may contain re-halogenating agents such as bromides (which are particularly preferred) (e.g., potassium bromide, sodium bromide, ammonium bromide, etc.) or chlorides (e.g., potassium chloride, sodium chloride, ammonium chloride, etc.) in addition to the above-described compounds. Further, each bath may contain one or more inorganic or organic acids as well as salts thereof having pH-buffering ability such as nitrates (e.g., sodium nitrate, ammonium nitrate, etc.), boric acid, borax, sodium metaborate, acetic acid, sodium acetate, sodium carbonate, potassium carbonate, phosphorous acid, phosphoric acid, sodium phosphate, citric acid, sodium citrate, tartaric acid, etc., and those compounds which have a fixing ability such as thiosulfates (e.g., sodium thiosulfate, ammonium thiosulfate, ammonium sodium thiosulfate, potassium thiosulfate, etc.), thiocyanates (e.g., sodium thiocyanate, ammonium thiocyanate, potassium thiocyanate, etc.), thiourea, thioether, etc.

In the present invention, various additives may also be added, if necessary, to the bleaching bath, the bleach-fixing bath, etc. For example, sulfites such as sodium sulfite and ammonium sulfite, various defoaming agents, or surfactants may be incorporated. Further, iodides such as potassium iodide and ammonium iodide, and hydroxylamine, hydrazine, and bisulfite addition compounds of aldehyde compounds may be incorporated therein.

As to the bleaching solution to be used in the present invention, the bleaching agent is used in an amount of about 0.1 to about 1 mol, preferably 0.2 to 0.5 mol, per liter of the bleaching solution. The pH of the bleaching solution be preferably about 4.0 to about 8.0 upon use.

As to the bleach-fixing solution to be used in the present invention, a bleaching agent is used in an amount of about 0.05 to about 0.5 mol, preferably 0.1 to 0.3 mol, per liter of the bleach-fixing solution, and a fixing agent may be present in an amount of about 0.3 to about 3 mols, preferably 0.5 to 2.5 mols. The pH of the solution is about 5 to about 8, preferably 6 to 7.5. A water-soluble bromide may be added to the bleaching bath and/or the bleach-fixing bath. The water-soluble bromide means a compound capable of being dissolved in the bleaching bath or the bleach-fixing bath to release bromide ion and, specifically, examples thereof include alkali metal bromides such as potassium bromide, sodium bromide, lithium bromide, etc., ammonium bromide, hydrobromic acid, and alkaline earth metal bromides such as magnesium bromide, calcium bromide strontium bromide, etc. Of these water-soluble bromides, ammonium bromide is particularly preferred.

In the present invention, these water-soluble bromides are preferably incorporated in the bleaching solution in an amount of about 0.5 to about 1.3 mol/liter, particularly preferably 0.7 to 1.3 mol/liter. In addition, in the case of incorporating these water-soluble bromides in the bleach-fixing bath, addition of the water-soluble bromides to the bleach-fixing bath in an amount of about 0.1 to about 0.5 mol/liter, particularly preferably 0.2 to 0.5 mol/liter, serves to provide better results than the addition of no such compounds to the bleach-fixing bath. Thus, the addition of the above-described water soluble bromides to the bleach-fixing bath represents a particularly preferred embodiment of the present invention.

Bleaching accelerators may also be added for accelerating bleaching in the present invention. Such bleaching accelerators may be added to either of the bleaching bath and the bleach-fixing bath, or to both of them. However, it is preferable to add them to at least the bleaching bath. The bleaching accelerators will be described in detail below.

The bleaching accelerators to be incorporated in the bleaching bath in the present invention may be optionally selected from among known bleaching accelerators. However, when at least one compound selected from among mercapto group- or disulfido bond-containing compounds, thiazolidine derivatives, thiourea derivatives, and isothiourea derivatives is used, the bleaching effect can be remarkably enhanced in comparison with the cause of incorporating these bleaching accelerators to a bleaching bath provided in conventional bleaching and fixing steps, and a much better bleaching-accelerating effect than is known using conventional bleaching baths and conventional silver-removing processes can be obtained, though the reasons therefore have not been precisely defined by Applicants. Thus, the use of the above-described bleaching accelerators is preferred in the present invention. In particular, bleaching accelerators represented by the following general formulae (I) to (IX) can be preferably used in the present invention.

General formula (I):

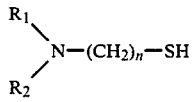

In the above general formula (I), $R_1$ and $R_2$, which may be the same or different, each represents a hydrogen atom, a substituted or unsubstituted lower alkyl group (preferably containing 1 to 5 carbon atoms, (e.g., a methyl group, an ethyl group, and a propyl group are particularly preferred) or an acyl group (preferably containing 1 to 3 carbon atoms, e.g., an acetyl group, a propionyl group, etc.), and n represents an integer of 1 to 3.

$R_1$ to $R_2$ may bond together to form a 5- or 6-membered ring containing O or N as a hetero atom. Substituted or unsubstituted lower alkyl groups are particularly preferred as $R_1$ and $R_2$.

Substituents for $R_1$ and $R_2$ include a hydroxyl group, a carboxyl group, a sulfo group, an amino group, etc.

General formula (II):

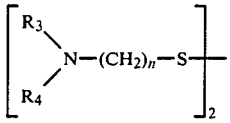

In the above general formula (II), $R_3$ and $R_4$ are the same as defined for $R_1$ and $R_2$ with respect to general formula (I), and n represents an integer of 1 to 3.

General formula (III):

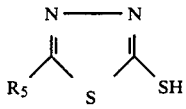

General formula (IV):

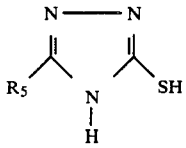

General formula (V):

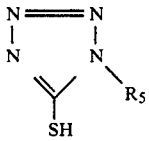

In the above general formulae (III) to (V), $R_5$ represents a hydrogen atom, a halogen atom (e.g., a chlorine atom, a bromine atom, etc.), an amino group, a substituted or unsubstituted lower alkyl group (preferably containing 1 to 5 carbon atoms, e.g., a methyl group, an ethyl group, and a propyl group being particularly preferable), or an amino group having an alkyl group substituent having 1 to 3 carbon atoms (e.g., a methylamino group, an ethylamino group, a dimethylamino group, a diethylamino group, etc.).

Substituents for $R_5$ include a hydroxy group, a carboxyl group, a sulfo group, an amino group, etc.

General formula (VI):

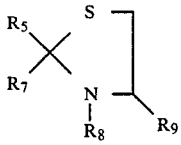

In the above general formula (VI), $R_6$ and $R_7$, which may be the same or different, each represents a hydrogen atom, an optionally substituted alkyl group (preferably, a lower alkyl group having 1 to 4 carbon atoms such as a methyl group, an ethyl group, a propyl group, etc.), an optionally substituted phenyl or optionally substituted 5- or 6-membered heterocyclic group (more specifically, a heterocyclic group containing at least one hetero atom such as a nitrogen atom, an oxygen atom, a sulfur atom or the like, e.g., a pyridine ring, a thiophene ring, a thiazolidine ring, a benzoxazole ring, a benzotriazole ring, a thiazole ring, an imidazole ring, etc.), and $R_8$ represents a hydrogen atom or an optionally substituted lower alkyl group (e.g., a methyl group, an ethyl group, etc., preferably containing 1 to 3 carbon atoms). Substituents for $R_6$ to $R_8$ include a hydroxyl group, a carboxyl group, a sulfo group, an amino group, a lower alkyl group having 1 to 4 carbon atoms, etc.

$R_9$ represents a hydrogen atom or a carboxyl group.

General formula (VII):

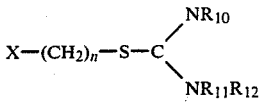

In the above general formula (VII), $R_{10}$, $R_{11}$, and $R_{12}$, which may be the same or different, each represents a hydrogen atom or a lower alkyl group (e.g., a methyl group, an ethyl group, etc., preferably containing 1 to 3 carbon atoms).

$R_{10}$ and $R_{11}$, or $R_{10}$ and $R_{12}$ may bond together to form a 5- or 6-membered ring.

X represents an amino group optionally having one or more substituents (e.g., a lower alkyl group having 1 to 4 carbon atoms such as a methyl group, an alkoxyalkyl group having 2 to 8 carbon atoms such as an acetoxymethyl group, etc.), a sulfonic acid group or a carboxyl group.

A hydrogen atom, a methyl group or an ethyl group are particularly preferred as $R_{10}$, $R_{11}$, and $R_{12}$, and, as X, an amino group or a dialkylamino group are particularly preferred.

General formula (VIII):

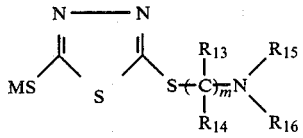

In the above general formula (VIII), $R_{13}$ and $R_{14}$ each represents a hydrogen atom, a hydroxy group, a substituted or unsubstituted amino group, a carboxy group, a sulfo group or a substituted or unsubstituted alkyl group having 1 to 4 carbon atoms, $R_{15}$ and $R_{16}$ each represents a hydrogen atom, a substituted or unsubstituted alkyl group having 1 to 3 carbon atoms, or a substituted or unsubstituted acyl group having 1 to 10 carbon atoms, wherein $R_{15}$ and $R_{16}$ may optionally bond together to form a 5-or 6-membered ring, M represents a hydrogen atom, an alkali metal atom or an ammonium group, and m represents an integer of 2 to 5.

General formula (IX):

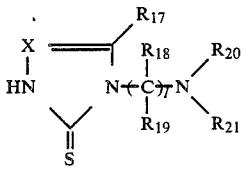

In the above general formula (IX), X represents N or C-R, and R, $R_{17}$, $R_{18}$, $R_{19}$ each represents a hydrogen atom, a halogen atom, an amino group, a hydroxy group, a carboxy group, a sulfo group or a substituted or unsubstituted alkyl group having 1 to 5 carbon atoms, $R_{20}$ and $R_{21}$ each represents a hydrogen atom, a substituted or unsubstituted alkyl group having 1 to 4 carbon atoms or an acyl group having 1 to 4 carbon atoms, (wherein $R_{20}$ and $R_{21}$ may optionally bond together to form a 5- or 6-membered ring), provided that $R_{20}$ and $R_{21}$ do not represent a hydrogen atom at the same time, and l represents an integer of 0 to 5.

Specific examples of compounds represented by general formulae (I) to (IX) are illustrated below.

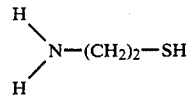

(I)-(1)

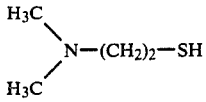

(I)-(2)

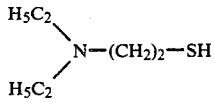

(I)-(3)

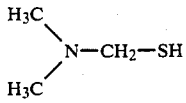

(I)-(4)

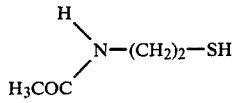

(I)-(5)

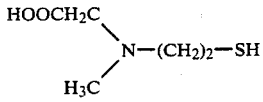

(I)-(6)

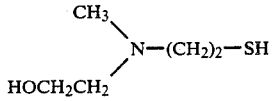

(I)-(7)

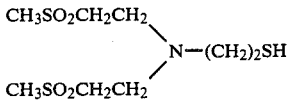

(I)-(8)

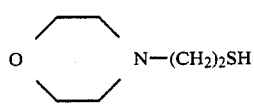

(I)-(9)

(II)-(1)

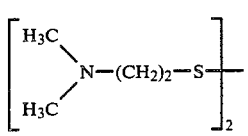

(II)-(2)

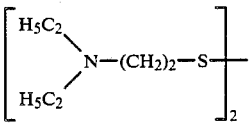

-continued
(II)-(3)
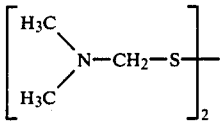
(II)-(4)
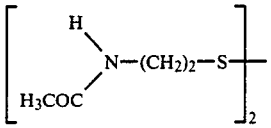
(II)-(5)
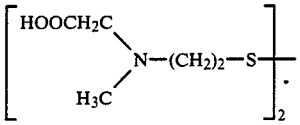
(II)-(6)
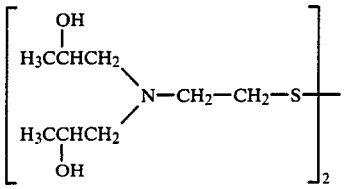
(II)-(7)
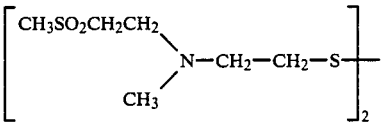
(II)-(8)
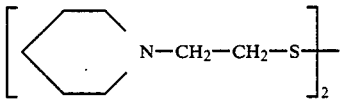
(II)-(9)
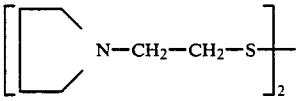
(II)-(10)
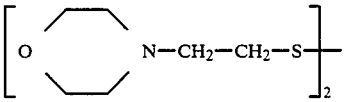
(III)-(1)
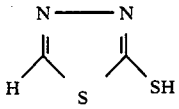
(III)-(2)
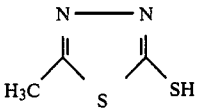
(III)-(3)
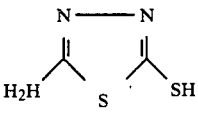
(III)-(4)
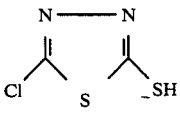
-continued
(IV)-(1)
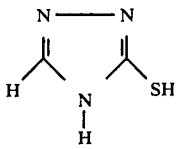
(IV)-(2)
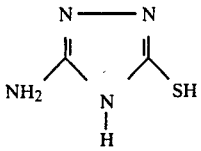
(IV)-(3)
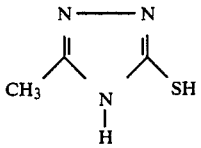
(V)-(1)
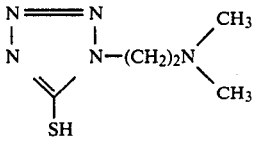
(V)-(2)
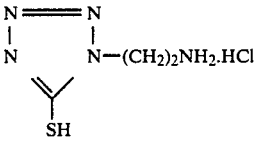
(VI)-(1)
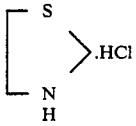
(VI)-(2)
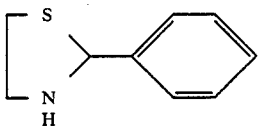
(VI)-(3)
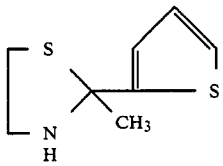
(VI)-(4)
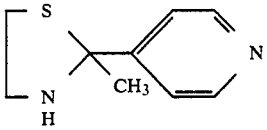
(VI)-(5)
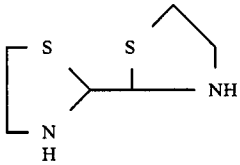

-continued (VI)-(6)

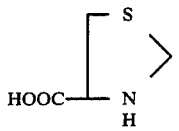

(VII)-(1)

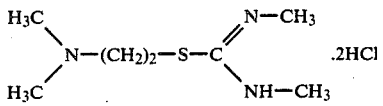

(VII)-(2)

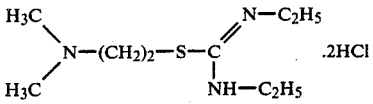

(VII)-(3)

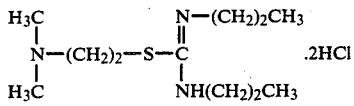

(VII)-(4)

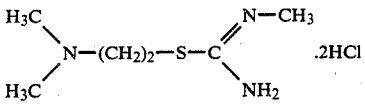

(VII)-(5)

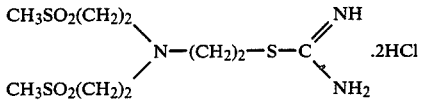

(VII)-(6)

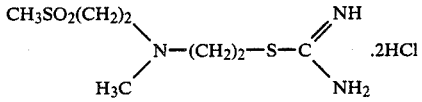

(VII)-(7)

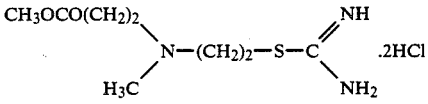

(VII)-(8)

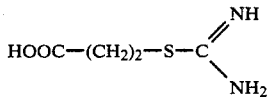

(VII)-(9)

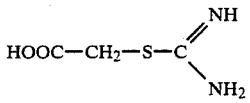

(VII)-(10)

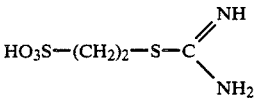

(VII)-(11)

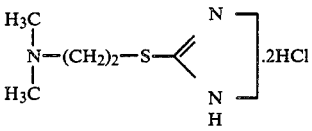

(VIII)-(1)

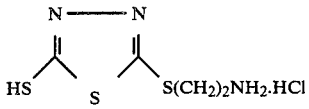

-continued (VIII)-(2)

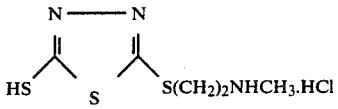

(VIII)-(3)

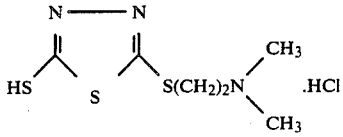

(IX)-(1)

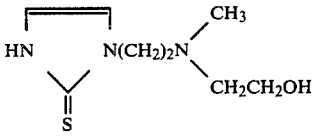

(IX)-(2)

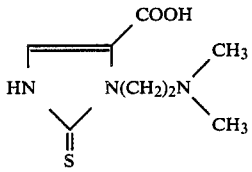

(IX)-(3)

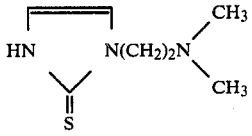

(IX)-(4)

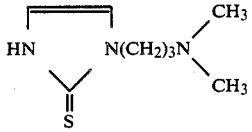

All of the above-illustrated compounds can be synthesized according to known processes. Reference may be made to U.S. Pat. No. 4,285,984 to G. Schwarzenbach et al.; *Helv. Chem. Acta.*, 38, 1147 (1955), and R. O. Clinton et al., *J. Am. Chem. Soc.*, 70, 950 (1948) as to synthesis of the compounds of the general formula (I), to Japanese Patent Application (OPI) No. 95,630/78 as to synthesis of the compounds of the general formula (II), to Japanese Patent Application (OPI) No. 52,534/79 as to synthesis of the compounds of the general formulae (III) and (IV), to Japanese Patent Application (OPI) Nos. 68,568/76, 70,763/76 and 50,169/78 as to synthesis of the compounds of the general formula (V), to Japanese Patent Publication No. 9,854/78 and Japanese Patent Application (OPI) No. 214,855/84 as to synthesis of the compounds of the general formula (VI), and to Japanese Patent Application (OPI) No. 94,927/78 as to synthesis of the compounds of the general formula (VII).

The compounds represented by the general formula (VIII) to be used in the present invention can be easily synthesized by alkylating 2,5-dimercapto-1,3,4-thiadiazole, as shown in *Advances in Heterocyclic Chemistry*, 9, 165–209 (1968).

The compounds represented by the general formula (IX) to be used in the present invention can be synthesized according to the processes described in A. Wohl. and W. Marckwald, Ber., 22, 568 (1889); M. Freund, Ber., 29, 2483 (1896); A. P. T. Eesson et al., *J. Chem.*

*Soc.*, 1932, 1806, R. G. Jones et al., *J. Am. Chem. Soc.*, 71, 4000 (1949), etc.

Addition of the bleaching accelerators to a processing solution is generally conducted by previously dissolving them in water, an alkaline solution, an organic acid, an organic solvent or the like. However, they may also be directly added as a powder to the bleaching bath with no adverse influences on their bleaching-accelerating effect.

When incorporating compounds having a mercapto group or disulfido bond within the molecule, such as thiazoline derivatives or isothiourea derivatives, as bleaching accelerators in the bleaching solution, these compounds are suitably added in amounts of about $1\times10^{-5}$ to about $1\times10^{-1}$ mol, preferably $1\times10^{-4}$ to $5\times10^{-2}$ mol, per liter of the processing solution, though the amounts may vary depending upon the kind of photographic materials to be processed, processing temperature, time required for an intended processing, etc.

The tabular grains to be used in the present invention preferably have a diameter-to-thickness ratio of about 5 or more, more preferably 5 to 50, particularly preferably 5 to 20.

The term "diameter of silver halide grains" as used herein means a diameter of a circle having the same area as the projected area of a grain. The tabular grains to be used in the present invention have a diameter of about 0.5 to about 5.0μ, preferably 0.5 to 2.0μ.

In general, tabular grains are in a plate-like form having two parallel planes, and hence "thickness" as used to describe grains contemplated for use in the present invention refers to the distance between the two parallel planes constituting the tabular grains.

As to the silver halide composition of tabular grains, silver bromide and silver bromoiodide are preferred, with silver bromoiodide containing about 0 to about 30 mol % silver iodide being particularly preferred.

The tabular grains can be prepared by properly combining processes known in the art.

Tabular silver halide emulsions are described in Cugnac and Chateau, "Evolution of Silver Bromide Crystals During Physical Ripening", *Science et Industrie Photographie,* Vol. 33, No. 2 (1962), pp. 121–125; Duffin, *Photographic Emulsion Chemistry* (Focal Press, New York, 1966), pp. 66–72; A. P. H. Trivelli and W. F. Smith, *Photographic Journal,* 80, 285 (1940), etc. and may be easily prepared by reference to the processes described in Japanese Patent Application (OPI) Nos. 127,921/83, 113,927/83 and 113,928/83.

In addition, tabular silver halide grains may be prepared by forming seed crystals wherein tabular grains account for about 40% by weight or more in an environment having a comparatively low pBr of 1.3 or less, and allowing the seed crystals to grow, simultaneously adding a silver salt solution and a halide solution while keeping the pBr at about the same level. In the course of the growth of grains, it is preferred to add the silver salt solution and the halide solution in such a manner so that no crystal nuclei will be newly formed.

The size of tabular grains may be adjusted by adjusting the temperature, selecting the kind and amount of solvent, and controlling the rate at which silver salt, the halide, etc. are added, upon growth of the grains.

Grain size, grain form (diameter-to-thickness ratio, etc.), distribution of grain size, growth rate of grains, etc. may be controlled by using a silver halide solvent as desired upon preparation of the tabular grains of the present invention. The solvent is used in an amount of about $1\times10^{-3}$ to about 1.0 wt %, particularly preferably $1\times10^{-2}$ to $1\times10^{-1}$ wt %, of the reaction solution. In the present invention, since the use of an increased amount of the solvent serves to make the grain size distribution a mono-dispersed type and accelerates the growth of grains and, in addition, tends to increase the thickness of the grains, the amount of solvent used is of importance.

Conventional silver halide solvents may be used in the present invention, for example, ammonia, thioethers, thioureas, etc. Specific examples of thioethers include those described in U.S. Pat. Nos. 3,271,157, 3,574,628, 3,790,387, etc.

Upon formation of tabular grains to be used in the present invention, it is preferred to increase the adding rate, amount, and concentration of a silver salt solution (e.g., an $AgNO_3$ aqueous solution) and a halide solution (e.g., a KBr aqueous solution) for accelerating the growth of grains. As to this technique, reference may be made to, for example, British Pat. No. 1,335,925, U.S. Pat. Nos. 3,650,757, 3,672,900, 4,242,445, Japanese Patent Application (OPI) Nos. 142,329/80, 158,124/80, etc.

The tabular grains to be used in the present invention may, if necessary, be chemically sensitized.

Examples of chemical sensitization processes include a so-called gold sensitization process using a gold compound (described in, for example, U.S. Pat. Nos. 2,448,060 and 3,320,069), a metal sensitization process using a metal such as iridium, platinum, rhodium or palladium (described in U.S. Pat. Nos. 2,448,060, 2,566,245, 2,566,263, etc.), a sulfur sensitization process using a sulfur-containing compound (described in, e.g., U.S. Pat. No. 2,222,264), a reduction sensitization process using polyamine (described in, for example, U.S. Pat. Nos. 2,487,850, 2,518,698, and 2,521,925) or a combination of two or more of these processes.

Particularly, the tabular grains to be used in the present invention are preferably subjected to gold sensitization, sulfur sensitization or a combination thereof in view of using silver economically.

In a layer containing the tabular grains of the present invention, the tabular grains preferably exist in a weight ratio of about 40% or more, more preferably 60% or more, based on the weight or all silver halide grains in the layer.

The thickness of the layer containing the tabular grains about 0.3 to about 5.0μ, preferably 0.5 to 4.0μ.

The amount of coated tabular grains (per one side of the support) is preferably about 0.5 to about 6 g/m$^2$, particularly preferably 1 to 4 g/m$^2$.

In the emulsion layer of the silver halide photographic material of the present invention may be incorporated ordinary silver halide grains (for example, spherical grains) in addition to the tabular grains. Such grains may-be prepared according to the processes described in P. Glafkides, *Chimie et Physique Photographique* (Paul Montel, 1967), G. F. Duffin, *Photographic Emulsion Chemistry* (The Focal Press, 1966), V. L. Zelikman et al. *Making and Coating Photographic Emulsion* (The Focal Press, 1964), etc.

Any of silver bromide, silver bromoiodide, silver chlorobromide, silver chlorobromoiodide, silver chloride, etc. may be used as the silver halide.

During formation or physical ripening of silver halide grains, cadmium salts, zinc salts, lead salts, thallium salts, iridium salts or complex salts thereof, rhodium salts or complex salts thereof, and iron salts or complex salts thereof may be present. If desired, the grains may be chemically sensitized in the same manner as described above for the tabular silver halide grains.

Various compounds may be incorporated in the photographic emulsion to be used in the present invention (for example, an emulsion containing tabular grains) for the purpose of preventing formation of fog or stabilizing photographic properties during the steps of producing, or during storage or processing of light-sensitive materials. For example, the following compounds represent known antifoggants or stabilizers contemplated for incorporation: azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.); mercaptopyrimidines; mercaptotriazines; thioketo compounds such as oxazolinethione; azaindenes (e.g., triazaindenes, tetraazaindenes (particularly 4-hydroxy-substituted (1,3,3a,7)tetraazaindenes), pentaazaindenes, etc.); benzenethiosulfonic acid, benzenesulfinic acid, benzenesulfonic acid amide, etc. Further, those antifoggants or stabilizers described in U.S. Pat. Nos. 3,954,474, 3,982,947, and Japanese Patent Publication No. 28,660/77, can be used.

The tabular grains to be used in the present invention are spectrally sensitized with sensitizing dyes.

Suitable sensitizing dyes include cyanine dyes, merocyanine dyes, complex cyanine dyes, complex merocyanine dyes, holopolar cyanine dyes, hemicyanine dyes, styryl dyes, and hemioxonol dyes. Particularly useful dyes are those belonging to the classes of cyanine dyes, merocyanine dyes, and complex merocyanine dyes. In these dyes, any of the nuclei ordinarily used as basic hetero ring nuclei in cyanine dyes can be used. Specifically, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring and those in which these nuclei are fused with an aromatic ring, i.e., an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc. can be used. These nuclei may also be substituted at the carbon atoms.

In the merocyanine dyes or complex merocyanine dyes, 5- or 6-membered hetero ring nuclei such as a pyrazolin-5-one nucleus, a thiohydantoin nucleus, a 2-thioxazolidone-2,4-dione nucleus, a thiazolidine-2,3-dione nucleus, a rhodanine nucleus, or a thiobarbituric acid nucleus may be used as ketomethylene structure-containing nuclei.

More specifically, those dyes as described in *Reseach Disclosure,* Vol. 176, No. 17643 (1978, Dec.), p. 23, and U.S. Pat. Nos. 4,425,425 and 4,425,426 may also be used.

These sensitizing dyes may be used alone or in combination of two or more. A combination of sensitizing dyes is often used particularly for the purpose of supersensitization.

A dye which itself does not have a spectrally sensitizing effect or a substance which substantially does not absorb visible light and which shows a supersensitizing effect may be incorporated together with the sensitizing dye. For example, aminostyryl compounds substituted by a nitrogen-containing hetero ring group (for example, those described in U.S. Pat. Nos. 2,933,390 and 3,635,721), aromatic organic acid-formaldehyde condensate (for example, those described in U.S. Pat. No. 3,743,510), cadmium salts, azaindene compounds, etc. may be incorporated for this purpose. Combinations described in U.S. Pat. Nos. 3,615,613, 3,615,641, 3,617,295, and 3,635,721 are also particularly useful.

The sensitizing dyes are used preferably in amounts of about 100 to about 1000 mg, particularly preferably 200 to 600 mg, per mol of tabular grains.

The sensitizing dyes to be used in the present invention are added to a silver halide emulsion as an aqueous solution or a solution dissolved in a water-miscible organic solvent such as methanol, ethanol, propyl alcohol, methylcellosolve, pyridine, etc.

The sensitizing dyes to be used in the present invention may also be dissolved by applying ultrasonic waves as described in U.S. Pat. No. 3,485,634. Other processes for dissolving or dispersing the sensitizing dyes of the present invention to be added to an emulsion include those described in U.s. Pat. Nos. 3,482,981, 3,585,195, 3,469,987, 3,425,835, 3,342,605, British Pat. Nos. 1,271,329, 1,038,029, 1,121,174, U.S. Pat. Nos. 3,660,101 and 3,658,546.

Addition of the sensitizing dyes to be used in the present invention to an emulsion is generally conducted before the emulsion is coated on a proper support, but may be conducted during a chemically ripening step or a silver halide-forming step.

The emulsion layer of the photographic material of the present invention may further comprise a plasticizer normally used in conjunction with polymers or emulsions for the purpose of improving pressure properties, etc.

For example, British Pat. No. 738,618 discloses the use of heterocyclic compounds, British Pat. No. 738,637 discloses the use of alkyl phthalates, British Pat. No. 738,639 discloses the use of alkyl esters, U.S. Pat. No. 2,960,404 discloses the use of polyhydric alcohols, U.S. Pat. No. 3,121,060 discloses the use of carboxyalkylcellulose, Japanese Patent Application (OPI) No. 5,017/74 discloses the use of paraffin and carboxylic acid salts, and Japanese Patent Publication No. 28,086/78 discloses the use of alkyl acrylate and organic acids.

Color-forming couplers may be added to photographic emulsion layers of the photographic light-sensitive material of the present invention, i.e., those compounds which can undergo an oxidative coupling reaction with an aromatic primary amine developing agent (e.g., a phenylenediamine derivative, an aminophenol derivative, etc.). For example, magenta couplers include 5-pyrazolone couplers, pyrazolobenzimidazole couplers, cyanoacetylcoumarone couplers, open-chain acylacetonitrile couplers, etc.; yellow couplers include acylacetamide couplers (e.g., benzoylacetanilides, pivaloylacetanilides, etc.), etc.; and cyan couplers include naphtholic couplers and phenolic couplers. Of these couplers, non-diffusible couplers having a hydrophobic group called a ballast group are desirable.

During processing according to the present invention, the use of light-sensitive materials containing as cyan couplers those represented by the following general formulae (X) and (XI) is preferable, since cyan can be reproduced without making the cyan images in a softer tone.

General formula (X):

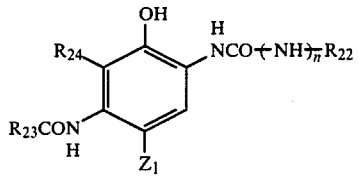

General formula (XI):

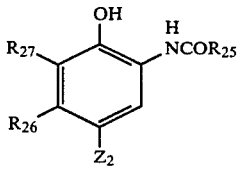

In the above general formulae, $R_{22}$, $R_{23}$, and $R_{25}$ each represents a substituted or unsubstituted aliphatic hydrocarbyl group having 1 to 20 carbon atoms, aryl group having 6 to 20 carbon atoms or 5- or 6-membered heterocyclic group, $R_{24}$ and $R_{27}$ each represents a hydrogen atom, a halogen atom, a substituted or unsubstituted aliphatic group having 1 to 3 carbon atoms, an aryl group having 6 carbon atoms or an acylamino group having 1 to 3 carbon atoms or, when taken together with $R_{23}$, $R_{24}$ represents non-metallic atoms forming a nitrogen-containing 5- or 6-membered ring, $R_{26}$ represents an optionally substituted alkyl group, $Z_1$ and $Z_2$ each represents a hydrogen atom or a group capable of being eliminated upon an oxidative coupling reaction with a developing agent, and n represents 0 or 1. Specific examples of the cyan couplers represented by the general formulae (X) or (XI) are illustrated below. Additionally, many other cyan couplers can be used, and specific examples thereof include phenolic couplers as described in U.S. Pat. No. 3,772,002, and 2,5-diacylaminophenolic couplers as described in U.S. Pat. Nos. 2,772,162, 3,758,308, 4,126,396, 4,334,011, 4,327,173, West German Patent Application (OLS) No. 3,329,729, European Pat. No. 121,365, etc.

(X-1)

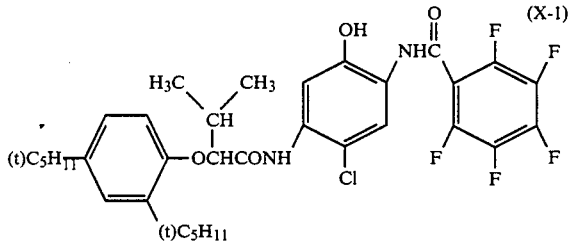

(X-2)

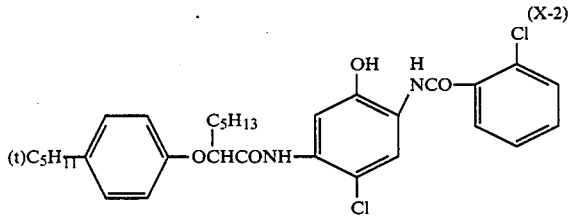

-continued (X-3)

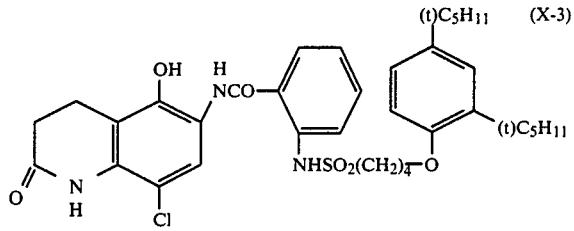

(XI-1)

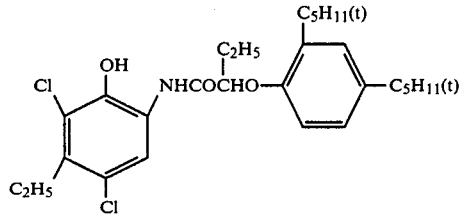

(X-4)

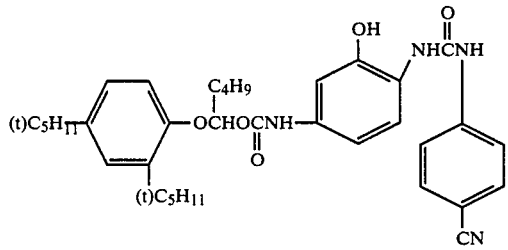

(X-5)

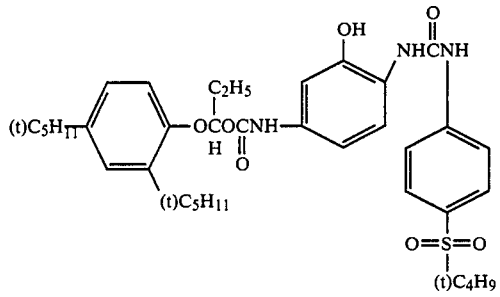

(X-6)

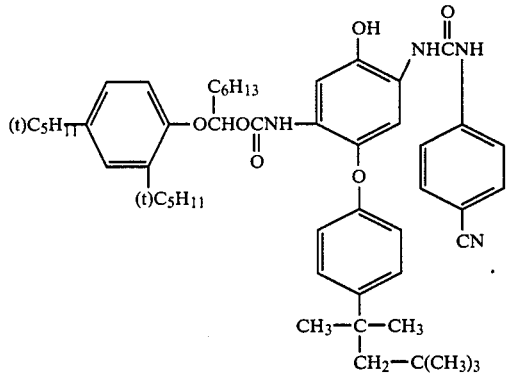

Other types of cyan couplers suitable for use in materials to be processed according to the present invention are 5-amido-substituted naphtholic couplers. Specific examples thereof are described in Japanese Patent Application (OPI) Nos. 237448/85, 153640/86 and 145557/86.

One example thereof is illustrated below:

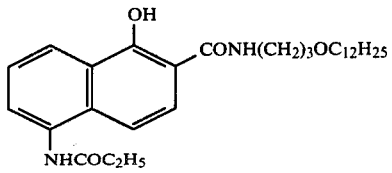

The couplers to be used in the light-sensitive material may be either a 4-equivalent type or a 2-equivalent type based on silver ion. Colored couplers having color-correcting effect or couplers capable of releasing a development inhibitor upon development (called DIR couplers) may also be used. In addition to DIR couplers, non-color-forming DIR coupling compounds capable of forming a colorless coupling reaction product and releasing a development inhibitor may also be incorporated.

The emulsion layers of the photographic light-sensitive material to be used in the present invention are not particularly limited as to other constituents, and various additives may be incorporated, if desired. For example, binders, surfactants, dyes, UV ray absorbents, hardeners, coating aids, thickening agent, etc., as described in *Research Disclosure,* No. 17643, Vol. 176, pp. 22–31 (1978, Dec.) may be used.

The color light-sensitive material to be processed according to the present invention preferably has a surface-protecting layer mainly comprising gelatin, a synthetic high molecular weight polymer substance such as a water-soluble polyvinyl compound or acrylamide polymer, or a natural high molecular weight polymer substance (for example, U.S. Pat. Nos. 3,142,568, 3,193,386, 3,062,674) on the surface thereof.

The surface-protecting layer may contain a surfactant, an antistatic agent, a matting agent, a slipping agent, a hardener, a thickening agent, etc. in addition to gelatin or other high molecular weight substances.

The photographic light-sensitive material to be used in the present invention may further contain, if desired, an interlayer, a filter layer, an antihalation layer, etc.

The photographic emulsion layers and other layers of the photographic light-sensitive material used in the present invention are coated on a flexible support such as plastic film, paper or cloth usually used for photographic light-sensitive materials. Useful flexible supports include films composed of semi-synthetic or synthetic high molecular weight polymers such as cellulose nitrate, cellulose acetate, cellulose acetate butyrate, polystyrene, polyvinyl chloride, polyethylene terephthalate, polycarbonate, etc. and papers coated or laminated with a baryta layer or an alpha-olefin polymer (for example, polyethylene, polypropylene, ethylene/butene copolymer, etc.). The support may be colored with a dye or a pigment, or may be blackened for intercepting light. The surface of the support is generally coated with a subbing layer subbed for improving adhesion to a photographic emulsion layer or the like. The support surface may be subjected to corona discharge treatment, UV ray irradiation, or flame treatment before or after the subbing treatment.

In the present invention, processes for coating an emulsion layer, a surface-protecting layer, etc. on a support are not particularly limited, and processes of simultaneously coating multi-layers described in, for example, U.S. Pat. Nos. 2,761,418, 3,508,947, 2,761,791, etc. can be preferably used.

As to the stratum structure of the photographic material of the present invention, various structures and within the scope of the materials contemplated for use. For example, there are (1) a stratum structure wherein a layer containing tabular silver halide grains is provided on a support, a silver halide emulsion layer containing high-speed silver halide grains of comparatively large particle size (0.5 to 3.0$\mu$) having a spherical form or having a diameter-to-thickness ratio of 5 or less is provided thereon, and a surface-protecting layer of gelatin or the like is further coated thereon; (2) a stratum structure wherein a tabular silver halide grains-containing layer is provided on a support, and a surface-protecting gelatin layer is further provided thereon; (3) a stratum structure wherein one silver halide emulsion layer is provided on a support, a tabular silver halide grains-containing layer is provided thereon, a high-speed silver halide emulsion layer is provided thereon, and a surface-protecting gelatin layer is provided thereon; (4) a stratum structure wherein a layer containing an ultraviolet ray absorbent or a dye, a tabular silver halide grains-containing layer, a silver halide emulsion layer, and a surface-protecting gelatin layer are provided in this order on a support; and (5) a stratum structure wherein a layer containing tabular silver halide grains and an ultraviolet ray absorbent or a dye, a silver halide emulsion layer, and a surface-protecting gelatin layer are provided in this order on a support. In these embodiments, the silver halide emulsion layer is not necessarily a single layer and may be composed of a plurality of silver halide emulsion layers spectrally sensitized to different wavelength regions.

The photographic light-sensitive materials to be processed according to the present invention specifically include color photographic light-sensitive materials such as color negative films, color reversal films, color papers, etc. as well as black-and-white photographic light-sensitive materials such as X-ray light-sensitive materials (for indirect X-ray or direct X-ray irradiation), lithographic light-sensitive materials, black-and-white photographic printing papers, black-and-white negative films, etc.

The color developer to be used for development-processing light-sensitive materials in accordance with the present invention is preferably an alkaline aqueous solution containing an aromatic primary amine color-developing agent as a major component. P-phenylenediamine compounds are preferably used as the color-developing agent, although aminophenol compounds are also useful. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline, and sulfates, hydrochlorides, phosphates, p-toluenesulfonates, tetraphenylborates, p-(t-octyl)benzenesulfonates thereof, etc. These diamines are generally more stable in a salt form than in a free form, thus being preferably used as salts.

The aminophenol derivatives include, for example, o-aminophenol, p-aminophenol, 4-amino-2-methylphenol, 2-amino-3-methylphenol, 2-hydroxy-3-amino-1,4-dimethylbenzene, etc.

In addition, those color-developing agents described by F. A. Mason in *Photographic Processing Chemistry,* (Focal Press), pp. 226–229, U.S. Pat. Nos. 2,193,015 and 2,592,364, Japanese Patent Application (OPI) No. 64,933/73, etc., may also be used. If necessary, two or more color-developing agents may be used in combination.

The color developer may further contain pH buffers such as alkali metal carbonates, borates, or phosphates, development inhibitors or antifoggants such as bromides, iodides, benzimidazoles, benzothiazoles or mercapto compounds, preservatives such as hydroxylamine, triethanolamine, compounds described in West German Patent Application (OLS) No. 2,622,950, sulfites or bisulfites, organic solvents such as diethylene glycol, development accelerators such as benzyl alcohol, polyethylene glycol, quaternary ammonium salts, amines, thiocyanates, 3,6-thiaoctane-1,3-diol, etc., dye-forming couplers, competitive couplers, nucleating agents such as sodium borohydride, auxiliary developing agents such as 1-phenyl-3-pyrazolidone, viscosity-imparting agents, and chelating agents such as aminopolycarboxylic acids (e.g., ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminehexaacetic acid, and compounds described in Japanese Patent Application (OPI) No. 195,845/83), 1-hydroxyethylidene-1,1'-diphosphonic acid, organophosphoric acids described in *Research Disclosure* No. 18170 (May, 1979), aminophosphoric acids (e.g., aminotris(methylenephosphonic acid, ethylenediamine-N,N,N',N'-tetramethylenephosphonic acid, etc.), and phosphonocarboxylic acids described in Japanese Patent Application (OPI) Nos. 102,726/77, 42,730/78, 121,127/79, 4,024/80, 4,025/80, 126,241/80, 65,955/80, 65,956/80, and *Research Disclosure,* No. 18170 (May, 1979).

The color-developing agents are generally used in a concentration of about 0.1 g to about 30 g, more preferably about 1 g to about 15 g, per liter of a color developer. The pH of the color developer is usually about 7 or more, most generally about 9 to about 13.

In the development processing of reversal color light-sensitive materials, color development is usually conducted after black-and-white development. This black-and-white developing solution may usually comprise known black-and-white developing agents such as dihydroxybenzenes (e.g., hydroquinone, hydroquinone monosulfonate, etc.), 3-pyrazolidones (e.g., 1-phenyl-3-pyrazolidone, etc.), and aminophenols (e.g., N-methyl-p-aminophenol, etc.).

The bleaching and bleach-fixing steps which take place after the color development step are the same as has been described hereinbefore.

The bleach-fixing step is generally followed by such steps as washing with water and stabilizing. More simple processing, i.e., conducting only washing with water or conducting only stabilizing and substantially eliminating the water-washing step, may also be employed.

Various known compounds may be added to the bath in the water-washing step for the purpose of preventing precipitation or stabilizing the washing water. For example, inorganic phosphoric acid, aminopolycarboxylic acids, organophosphoric acids, etc. bactericides and fungicides capable of preventing the generation of various bacteria, algae, fungi, etc. (for example, those compounds which are described in *J. Antibact. Antifung. Agents,* Vol. 11, No. 5, 207–223 (1983) and in Hiroshi Horiguchi: "Bokin-Bobai-no-Kagaku", Sankyo Shuppan Co., Ltd. (1982), metal salts such as magnesium salts and aluminum salts, alkali-metal and ammonium salts, and those compounds which are described in West, *Phot. Sci. Eng.,* 6, 344–359 (1965), etc. may be added.

The water-washing step may be conducted by countercurrent washing (using, for example, 2 to 9 baths) to save water. Further, in place of the water-washing step, a multistage countercurrent stabilize-processing step as described in Japanese Patent Application (OPI) No. 8,543/82, may be conducted. In this step, various compounds are added to the stabilizing baths for the purpose of stabilizing images. For example, the following compounds may be added: various buffers for controlling the pH of films to a pH of 3 to 8, for example (for example, borates, metaborate, borax, phosphates, carbonates, potassium hydroxide, sodium hydroxide, aqueous ammonia, monocarboxylic acids, dicarboxylic acids, polycarboxylic acids, etc. which may be used in combination), and aldehydes such as formalin, etc. In addition, various additives such as chelating agents (e.g., inorganic phosphoric acids, aminopolycarboxylic acids, organophosphonic acids, aminopolyphosphonic acids, phosphonocarboxylic acids, etc.), bactericides (e.g., thiazole type compounds, isothiazole type compounds, halogenated phenols, sulfanilamides, benzotriazoles, etc.), surfactants, fluorescent brightening agents, hardeners, etc. may also be added to the stabilizing baths. Two or more compounds for different purposes may be used in combination. Further, various ammonium salts such as ammonium chloride, ammonium nitrate, ammonium sulfate, ammonium phosphate, ammonium sulfite, ammonium thiosulfate, etc. as agents for adjusting the pH of processed films, may be added thereto.

With color light-sensitive materials for photography, the (washing-stabilizing) step after bleach-fixing may be replaced by the aforesaid stabilizing step and the water-washing step (water-saving type). In this situation, formalin in the stabilizing bath may be omitted when 2-equivalent magenta couplers are used.

Various processing solutions in the present invention are used at temperatures of about 10° C. to about 50° C. Temperatures of 33° C. to 38° C. are standard, but higher temperatures may be employed for accelerating processing and thus shortening processing time, or lower temperatures may be employed to improve the image quality or the stability of the processing solutions. In addition, processing using cobalt intensification or hydrogen peroxide intensification as described in West German Pat. No. 2,226,770 or U.S. Pat. No. 3,674,499 may be conducted for conserving the silver content of the light-sensitive materials.

The time for each processing step may, if necessary, be shorter than the standard time for conducting each step, within a time range which causes no trouble for accelerating the processing.

In continuous processing, a replenishing solution for each processing solution may be used to prevent fluctuation of solution composition, thus, constant results can be obtained. The amounts of replenishing solutions may be reduced to a half of, or less than a half of, standard replenishing amounts for the purpose of decreasing the cost.

Each processing bath may have, if desired, a heater, a temperature sensor, a liquid level sensor, a circulating pump, a filter, various floating lids, various squeezees, etc.

The present invention may be applied to various color light-sensitive materials. Typical examples thereof include color negative films for cinema, color reversal films for slides or television, color papers, color positive films, color reversal papers, etc. The present invention can also be applied to black-and-white light-sensitive materials utilizing a mixture of three-color couplers described in *Research Disclosure,* No. 17123 (July, 1978).

The present invention enables one to perform extremely rapid photographic processing to form images with good quality, even when silver halide photographic materials containing tabular silver halide grains are used. Therefore, the present invention not only reduces the total cost of photographic processing, but also provides more photographing chances since the color light-sensitive material to be used in the present invention has a high sensitivity due to the use of tabular grains, thus being advantageous for both photographers and development processors.

The present invention is now illustrated in greater detail by reference to the following examples which, however, are not to be construed as limiting the present invention in any way. Unless otherwise indicated, all parts, percents, ratios and the like are by weight.

EXAMPLE 1

Multi-layer color negative film samples A and B comprising a triacetyl cellulose film support having provided thereon the layers of the following formulations were prepared.

In Sample A, each emulsion layer contained spherical silver halide grains prepared according to the process described in U.S. Pat. No. 4,497,895 and, in sample B, a blue-sensitive layer emulsion contained spherical silver halide grains prepared in the same manner as with Sample A, and a green-sensitive layer and a red-sensitive layer contained tabular silver halide grains having an average grain diameter-to-grain thickness ratio of about 9 and prepared according to the process described in U.S. Pat. No. 4,439,520.

1st layer: Antihalation layer
Gelatin: 1.5 g/m$^2$
Black colloidal silver: 0.2 g/m$^2$
2nd layer: Interlayer
Gelatin layer containing an emulsion dispersion of 2,5-di-t-octylhydroquinone (0.1 g/m$^2$): 1.0 g/m$^2$
3rd layer: Less sensitive red-sensitive emulsion layer
AgBrI emulsion . . . coated in a silver amount of 1.6 g/m$^2$
Sensitizing dye I . . . $6\times10^{-5}$ mol per mol of silver
Sensitizing dye II . . . $1.5\times10^{-5}$ mol per mol of silver
Coupler EX-1 . . . 0.04 mol per mol of silver
Coupler EX-2 . . . 0.003 mol per mol of silver
Coupler EX-3 . . . 0.0006 mol per mol of silver
4th layer: More sensitive red-sensitive emulsion layer
AgBrI emulsion . . . coated in a silver amount of 1.4 g/m$^2$
Sensitizing dye I . . . $3\times10^{-5}$ mol per mol of silver
Sensitizing dye II . . . $1.2\times10^{-5}$ mol per mol of silver
Coupler EX-4 . . . 0.02 mol per mol of silver
Coupler EX-2 . . . 0.016-mol per mol of silver
5th layer: Interlayer
The same as the 2nd layer
6th layer: Less sensitive green-sensitive emulsion layer
Monodispersed AgBrI emulsion . . . coated in a silver amount of 1.2 g/m$^2$
Sensitizing dye III . . . $3\times10^{-5}$ mol per mol of silver
Sensitizing dye IV . . . $1\times10^{-5}$ mol per mol of silver
Coupler EX-5 . . . 0.05 mol per mol of silver
Coupler EX-6 . . . 0.008 mol per mol of silver
Coupler EX-3 . . . 0.0015 mol per mol of silver
7th layer: More sensitive green-sensitive emulsion layer
AgBrI emulsion . . . coated in a silver amount of 1.3 g/m$^2$
Sensitizing dye III . . . $2.5\times10^{-5}$ mol per mol of silver
Sensitizing dye IV . . . $0.8\times10^{-5}$ mol per mol of silver
Coupler EX-7 . . . 0.017 mol per mol of silver
Coupler EX-6 . . . 0.003 mol per mol of silver
Coupler EX-8 . . . 0.003 mol per mol of silver
8th layer: Yellow filter layer
Gelatin layer containing in a gelatin aqueous solution yellow colloidal silver (0.04 g/m$^2$) and an emulsion dispersion of 2,5-di-t-octylhydroquinone (0.1 g/m$^2$): 1.5 g/m$^2$
9th layer: Less sensitive blue-sensitive emulsion layer
AgBrI emulsion . . . coated in a silver amount of 0.7 g/m$^2$
Coupler EX-9 . . . 0.25 mol per mol of silver
Coupler EX-2 . . . 0.015 mol per mol of silver
10th layer: More sensitive blue-sensitive emulsion layer
AgBrI emulsion . . . coated in a silver amount of 0.6 g/m$^2$
Coupler EX-9 . . . 0.06 mol per mol of silver
11th layer: First protective layer
AgBrI (AgI: 1 mol %; average grain size: 0.07$\mu$) . . . coated in a silver amount of 0.5 g/m$^2$
Gelatin layer containing an emulsion dispersion of an ultraviolet ray absorbent, UV-1 (0.3 g/m$^2$)
12th layer: Second protective layer
A gelatin layer containing trimethyl methacrylate particles (diameter: 1.5$\mu$, 0.2 g/m$^2$) was coated.

In addition to the above-described ingredients, gelatin hardener H-1 and a surfactant were added to each layer.

Additionally, compounds used for preparing the above layers are as follows:

Sensitizing dye I: Anhydro-5,5'-dichloro-3,3'-di-($\gamma$-sulfopropyl)-9-ethylthiacarbocyanine hydroxide pyridinium salt Sensitizing dye II: Anhydro-9-ethyl-3,3'-di-($\gamma$-sulfopropyl)-4,5,4',5'-dibenzothiacarbocyanine hydroxide triethylamine salt Sensitizing dye III: Anhydro-9-ethyl-5,5'-dichloro-3,3'-di-($\gamma$-sulfopropyl)oxacarbocyanine sodium salt Sensitizing dye IV: Anhydro-5,6,5',6'-tetrachloro-1,1'-diethyl-3,3'-di($\beta$-($\beta$-($\gamma$-sulfopropyl)ethoxy)ethyl-)imidazolocarbocyanine hydroxide sodium salt EX-1
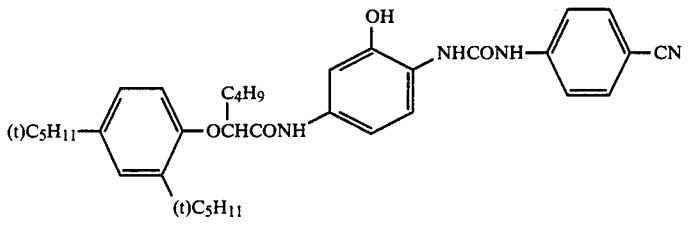
EX-2
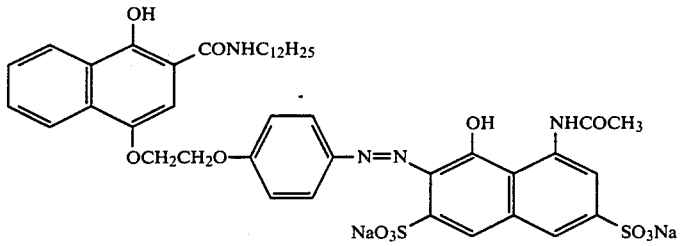
EX-3
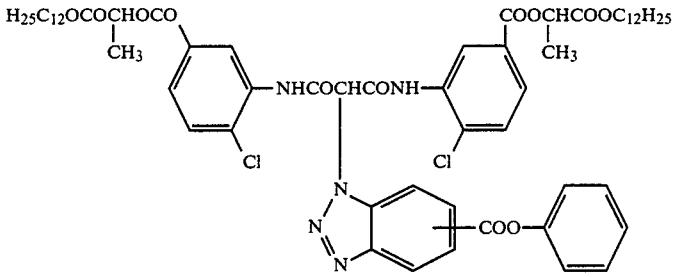
EX-4
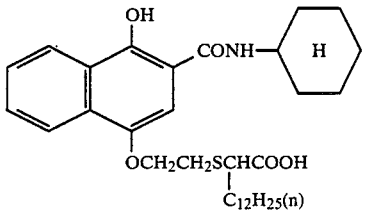
EX-5
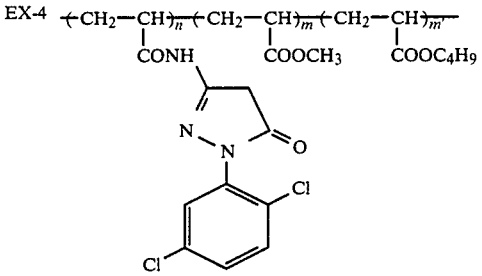
(n/m + m' = 1 m/m' = 1 (by wt)
M.W. about 40,000)
EX-6
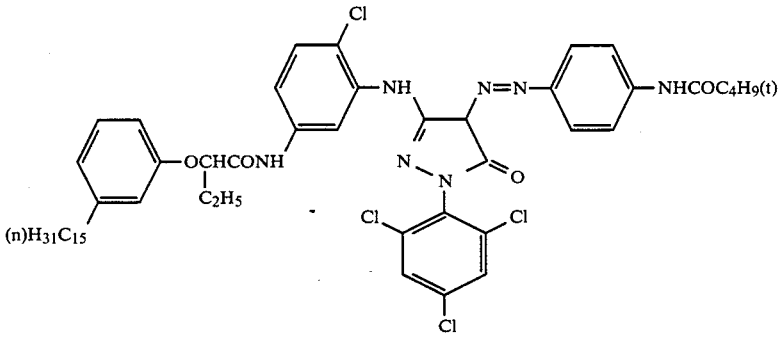

-continued

EX-7

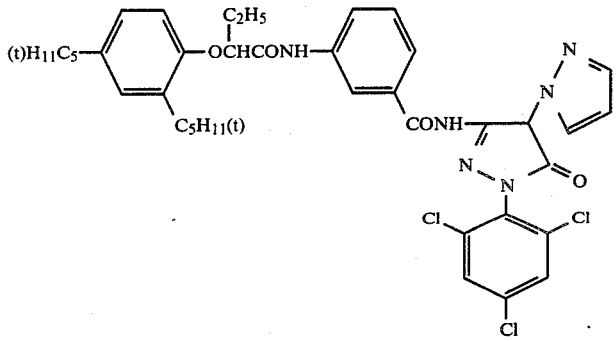

EX-8

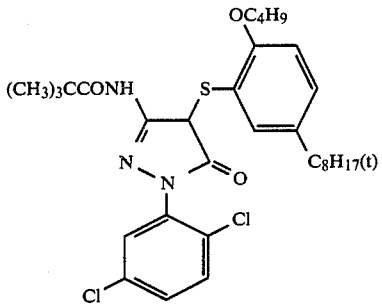

EX-9

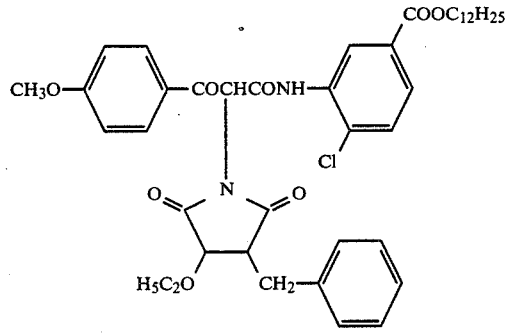

$CH_2{=}CH{-}SO_2{-}CH_2{-}CONH{-}(CH_2)_2NHCOCH_2SO_2CH{=}CH_2$ H-1

UV-1

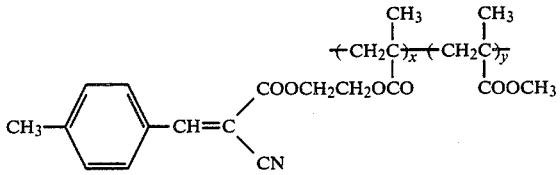

x/y = 7/3 (by wt)

The thus prepared samples A and B were subjected to 25 cms exposure using a tungsten light source fitted with a filter to adjust color temperature to 4,800 K., then developed at 38° C. according to the following processing steps:

Processing 1 (Comparative processing)
Color development: 3'15"
Bleaching: 3'15"
Fixing: 3'15"
Washing with water: 3'15"
Stabilizing: 1'05"
Processing 2 (Comparative processing)
Color development: 3'15"
Bleach-fixing: 6'30"
Washing with water: 3'15"
Stabilizing: 1'05"
Processing 3 (Processing of the present invention)
Color development: 3'15"
Bleaching: 3'15"
Bleach-fixing: 3'15"
Washing with water: 3'15"
Stabilizing: 1'05"

Formulations of the processing solutions used in the above steps are as follows.

Color developer
Diethylenetriaminepentaacetic acid: 1.0 g
1-Hydroxyethylidene-1,1-diphosphonic acid: 2.0 g
Sodium sulfite: 4.0 g
Potassium carbonate: 30.0 g
Potassium bromide: 1.4 g
Potassium iodide: 1.3 mg
Hydroxylamine sulfate: 2.4 g
4-(N-Ethyl-N-β-hydroxyethylamino)-2-methylaniline sulfate: 4.5 g
Water to make: 1 liter
pH: 10.00
Bleaching solution
Ferric ammonium/ethylenediaminetetraacetate: 100.0 g
Ethylenediaminetetraacetic acid disodium salt: 10.0 g
Aqueous ammonia: 7.0 ml
Ammonium nitrate: 10.0 g
Ammonium bromide: 150.0 g
Water to make: 1 liter
pH: 6.0
Fixing solution
Ethylenediaminetetraacetic acid disodium salt: 1.0 g
Sodium sulfite: 4.0 g
Sodium bisulfite: 4.6 g
Ammonium thiosulfate aq. soln. (70%): 175 ml
Water to make: 1 liter
pH: 6.6
Bleach-fixing solution
Ferric ammonium ethylenediaminetetraacetate: 80.0 g
Disodium ethylenediaminetetraacetate: 4.0 g Sodium sulfite: 12.0 g
Ammonium thiosulfate aq. soln. (70%): 175 ml
Aqueous ammonia: 12.0 ml
Water to make: 1 liter
pH: 6.8
Stabilizing solution
Formalin (37% w/v): 2.0 ml
Polyoxyethylene-p-monononylphenyl ether (average polymerization degree: 10): 0.3 g
Water to make: 1 liter Each sample having been processed as described above was subjected to measurement of the magenta stain density in the minimum density portion, and the amount of residual silver in the maximum color density portion was measured by fluorescent X-ray analysis.

Results thus obtained are shown in Table 1.

TABLE 1

| No. | Processing | Sample | Magenta Stain | Amount of Residual Silver ($\mu g/cm^2$) |
|---|---|---|---|---|
| 1* | 1 | A | 0.01 | 3.8 |
| 2* | 2 | A | 0.02 | 23.4 |
| 3* | 3 | A | 0.00 | 2.1 |
| 4* | 1 | B | 0.05 | 9.5 |
| 5* | 2 | B | 0.06 | 35.2 |
| 6** | 3 | B | 0.00 | 2.5 |

*Comparative example
**Example of the present invention

In Table 1, it is easily seen that magenta stain values of No. 1 to No. 5 show a significant density difference from that of No. 6 according to the present invention.

It is demonstrated from Table 1 that, when applied to a color light-sensitive material containing tabular silver halide grains, the process of the present invention provides good silver-remaining properties, and less magenta stain, thus exhibiting surprisingly superior results.

EXAMPLE 2

Processing Steps were conducted in the same manner as in Example 1 except for adding bleaching accelerators ($5\times10^{-3}$ mol/liter) described in Table 2 to the bleaching or bleach-fixing bath in the following processing steps 4 to 6 to obtain the results shown in Table 2.

Processing 4 (Comparative processing)
Color development: 3'15"
Bleaching (bleaching accelerator being added): 1'30"
Fixing: 3'15"
Washing with water: 2'10"
Stabilizing: 20"
Processing 5 (Comparative processing)
Color development: 3'15"
Bleach-fixing (bleaching accelerator being added): 4'45"
Washing with water: 2'10"
Stabilizing: 20"
Processing 6 (Present invention)
Color development: 3'15"
Bleaching (bleaching accelerator being added): 1'
Bleach-fixing: 3'15"
Washing with water: 2'10"
Stabilizing: 20"

Additionally, bleaching accelerators shown in Table 2 are the following compounds:

Bleaching accelerator-1

-continued

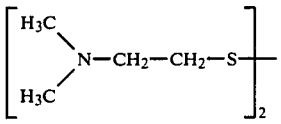

Bleaching accelerator -2

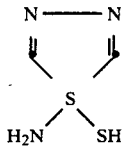

As is apparent from Table 2, it is seen that even with sample B (light-sensitive material containing tabular grains) with which the comparative processings fail to provide good results, processing according to the present invention can provide superior results.

TABLE 2

| No. | Processing | Bleaching Accelerator | Sample | Magenta Stain | Amount of Residual Silver ($\mu g/cm^2$) |
|---|---|---|---|---|---|
| 1* | 4 | 1 | A | 0.00 | 1.8 |
| 2* | 4 | 2 | " | 0.00 | 2.2 |
| 3* | 5 | 1 | " | 0.01 | 4.0 |
| 4* | 5 | 2 | " | 0.01 | 4.1 |
| 5* | 6 | 1 | " | 0.00 | 1.0 |
| 6* | 6 | 2 | " | 0.00 | 1.9 |
| 7* | 4 | 1 | B | 0.05 | 7.5 |
| 8* | 4 | 2 | " | 0.07 | 8.6 |
| 9* | 5 | 1 | " | 0.08 | 12.3 |
| 10* | 5 | 2 | " | 0.08 | 13.1 |
| 11** | 6 | 1 | " | 0.00 | 1.2 |
| 12** | 6 | 2 | " | 0.00 | 1.9 |

*Comparative example
**Example of the present invention

EXAMPLE 3

Processing steps were conducted in the same manner as in Example 2 except for using ferric ammonium diethylenetriamineacetate in place of ferric ammonium ethylenediaminetetraacetate in the bleaching solution and the bleach-fixing solution used in Example 2. The same results as shown in Table 2 were obtained upon carrying out the same steps using the same samples.

While the present invention has been described in detail and with reference to specific embodiments thereof, it is apparent to one skilled in the art that various changes and modifications can be made therein without departing from the spirit and the scope of the present invention.

What is claimed is:

1. An image-forming process, which comprises imagewise exposing a silver halide color photographic material comprising a support having provided thereon at least one silver halide emulsion layer containing tabular silver halide grains having a diameter-to-thickness ratio of 5 or more, subjecting the exposed photographic material to color development processing, then processing the photographic material in a bath mainly having a bleaching ability and successively in a bath having a bleach-fixing ability.

2. An image-forming process as claimed in claim 1, wherein said bath mainly having a bleaching ability contains a bleaching agent selected from the group consisting of red prussiates, dichromates, persulfates, inorganic ferric salts and organic ferric salts.

3. An image-forming process as claimed in claim 2, wherein said bleaching agent is a ferric aminopolycarboxylate complex salt.

4. An image-forming process as claimed in claim 2, wherein said bleaching agent is present in an amount of about 0.1 to about 1 mol per liter of bleaching solution, and the pH of the bleaching solution is about 4.0 to about 8.0.

5. An image-forming process as claimed in claim 1, wherein said bath mainly having a bleaching ability and/or said bath having a bleach-fixing ability contains a bleaching accelerator selected from the group consisting of mercapto compounds, disulfido bond-containing compounds, thiazolidine derivatives, thiourea derivatives and isothiourea derivatives in an amount from about 1 times $10^{-5}$ to about $10^{-1}$ mol per liter of the bath.

6. An image-forming process as claimed in claim 1, wherein said diameter-to-thickness ratio of said tabular silver halide grains is 5 to 20.

7. An image-forming process as claimed in claim 1, which further comprises a water-washing step after processing said material in the bleaching bath and before processing in the bleach-fixing bath.

8. An image-forming process as claimed in claim 1, which further comprises washing with water and stabilizing said material following bleach-fixing processing.

9. An image-forming process as claimed in claim 1, wherein the processing solutions are used at temperatures of about 10° C. to about 50° C.

* * * * *